United States Patent [19]

Ikoma et al.

[11] Patent Number: 4,840,042

[45] Date of Patent: Jun. 20, 1989

[54] HEAT PUMP SYSTEM

[75] Inventors: Mitsuhiro Ikoma, Nara; Kazuo Nakatani, Osaka; Yuji Yoshida, Hyogo; Takeshi Tomizawa, Nara; Koji Arita, Osaka, all of Japan

[73] Assignee: Matsushita Electric Industrial Co., Ltd., Japan

[21] Appl. No.: 226,084

[22] Filed: Jul. 29, 1988

[30] Foreign Application Priority Data

Jul. 31, 1987 [JP] Japan ..... 62-192949
Oct. 26, 1987 [JP] Japan ..... 62-269631
Oct. 26, 1987 [JP] Japan ..... 62-269632

[51] Int. Cl.[4] ..... F25B 13/00

[52] U.S. Cl. ..... 62/324.1; 62/114; 62/500; 62/502

[58] Field of Search ..... 62/114, 500, 502, 510, 62/512, 527, 528, 324.1

[56] References Cited

U.S. PATENT DOCUMENTS 3,152,457 10/1964 Zotos ..... 62/500
4,179,898 12/1979 Vakil ..... 62/114
4,242,885 1/1981 Quack et al. ..... 62/500
4,423,603 1/1984 Oquni et al. ..... 62/324.1
4,625,522 12/1986 Cheron et al. ..... 62/11 X
4,722,195 2/1988 Suzuki et al. ..... 62/502 X
4,745,777 5/1988 Morishita et al. ..... 62/512 X

*Primary Examiner*—Lloyd L. King
*Attorney, Agent, or Firm*—Wenderoth, Lind & Ponack

[57] ABSTRACT

A heat pump system which comprises a main heat pump circuit filled with non-azeotropic mixed coolant and including a compressor, a utility-side heat exchanger, a throttling device, a source-side heat exchanger, etc.,; a fractionating separator having an upper end fluid-connected with an exit side of the utility-side heat exchanger; a reservoir disposed beneath the fractionating separator and having a bottom fluid-connected through a shut-off valve with a low pressure piping on an inlet side of either the source-side heat exchanger or the utility-side heat exchanger; and a coolant ejector disposed between the compressor and the utility-side heat exchanger, wherein a gaseous medium generated from the fractionating separator when the reservoir is heated is guided to a suction port of the coolant ejector to flow into the main heat pump circuit.

10 Claims, 3 Drawing Sheets

HEAT PUMP SYSTEM

BACKGROUND OF THE INVENTION

1. Field of the Invention

The present invention relates to a heat pump system operable with the use of a non-azeotropic mixed coolant and capable of changing the composition of the non-azeotropic mixed coolant while storing a high boiling point coolant separated from the non-azeotropic mixed coolant.

2. Description of the Prior Art

Hitherto, the heat pump system capable of changing the composition of the non-azeotropic mixed coolant while storing a high boiling point coolant separated from the non-azeotropic mixed coolant has been available in the form as shown in FIG. 6 of the accompanying drawing. Referring to FIG. 6, the system comprises a main fluid circuit including a compressor 1, a condenser 2, a throttling device 3 and an evaporator 4 all fluid-connected as shown. Reference numeral 5 represents a fractionating separator having an upper end fluid-connected with the outlet of the condenser 2 through a piping 6 and also with the inlet of the evaporator 4 through a pressure reducer 7. A reservoir 8 is disposed beneath a lower end of the fractionating separator 5, the bottom of which is fluid-connected with the pressure reducer 7 through a shut-off valve 9. This reservoir 8 has a heater 10 built therein.

The prior art heat pump system of the construction described with reference to FIG. 6 is selectively operable in one of the two modes; the non-fractionating mode in which the system operates with the mixed coolant filled therein without altering the composition thereof, and the fractionating mode in which, while a high boiling point coolant is stored, the system operates with the composition rich of a low boiling point coolant. Hereinafter, the method practiced by the prior art system for changing the composition of the non-azeotropic mixed coolant filled therein will be described.

During the non-fractionating mode, and when the heater 10 is turned off, the reservoir 8 merely stores an excessive coolant and, during the closure of the shut-off valve 9, it stores the coolant, but during the opening of the shut-off valve 9, the coolant is in part stored and in part passed to the evaporator 4 through the pressure reducer 7. Accordingly, the main fluid circuit operates with the mixed coolant whose composition is rich of a high boiling point coolant filled in the system.

On the other hand, during the fractionating mode, and when the shut-off valve 9 is closed and the heater 10 is turned on, a low boiling point coolant contained in the coolant stored in the reservoir 8 is evaporated to pass upwardly through the interior of the fractionating separator 5. At this time, a liquid coolant is supplied from the exhibit of the condenser 2 by way of the piping 6 to the fractionating separator 5 in which fractionating takes place by the effect of a gas-liquid contact so that the gaseous medium which ascends becomes rich of the low boiling point coolant while the gaseous medium which descends becomes rich of the high boiling point cooling, allowing the high boiling point coolant to be stored in the reservoir 8 in the form of a condensed liquid. The ascending gaseous medium rich of the low boiling point coolant flows into the evaporator 4 through the pressure reducer 7 and, therefore, the main fluid circuit operates with the composition rich of the low boiling point coolant.

The heat pump system of such a composition-variable type is applied in, for example, a hot-water supply system and is usually operated with the filled composition rich of the high boiling point coolant so that, during the use thereof, a hot water can be available. Where the hot water is stored in a time as short as possible, the heat pump system can be operated with the composition rich of the low boiling point coolant having a high heating capability.

However, the prior art heat pump system of the above described type has a problem in that, since the fractionating is carried out by the use of the heater, the energy conversion efficiency tends to be lowered at the time the composition is changed. In other words, the amount of heat produced by the heater is merely utilized for the production of the gaseous medium for the fractionating and, for example, no utilization by the heat recovery to the site of use where hot water is actually utilized is effected.

SUMMARY OF THE INVENTION

Accordingly, the present invention has for its essential object to provide a refrigerating cycle system wherein the amount of heat utilized for the production of the gaseous medium can be effectively utilized and wherein the fractionating can be promoted.

To this end, the present invention provides an improved heat pump system wherein a coolant ejector is provided upstream of a utility-side heat exchanger condenser) with respect to the direction of flow of the coolant and has a suction port fluid-connected with the upper end of the fractionating separator so that, during the fractionating mode, the low boiling point coolant contained in the coolant stored in the reservoir can be mainly evaporated by the heater and the resultant gaseous medium rich of the low boiling point coolant ascending through the interior of the fractionating separator is guided to a suction port of a coolant ejector disposed upstream of the condenser, wherefore the amount of heat produced by the heater can be effectively utilized when the gaseous medium is fed back to the condenser for condensation thereof.

BRIEF DESCRIPTION OF THE DRAWINGS

This and other objects and features of the present invention will become apparent from the following description taken in conjunction with preferred embodiments thereof with reference to the accompanying drawings, in which.

DETAILED DESCRIPTION OF THE EMBODIMENTS

Figure 1:
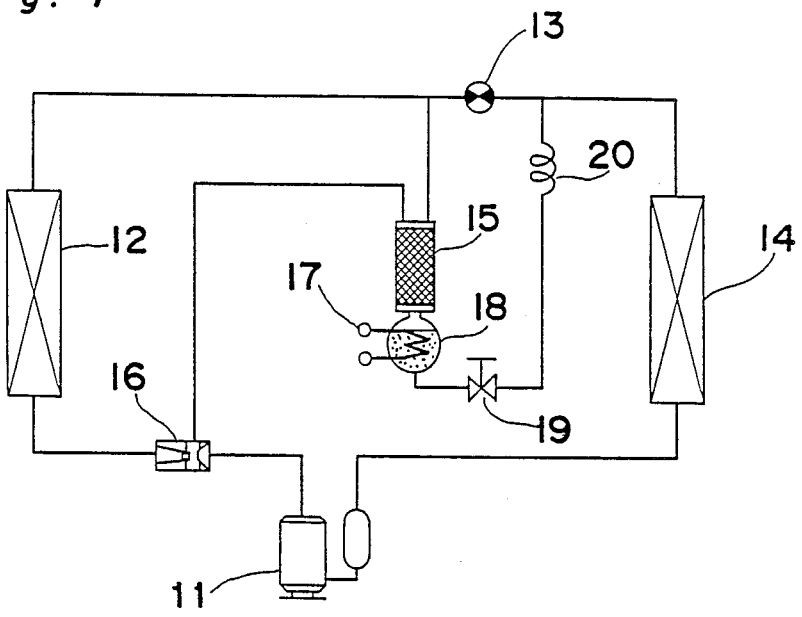
FIG. 1 is a schematic fluid circuit diagram showing a heat pump system wherein a coolant ejector is provided upstream of the utility-side heat exchanger (condenser) according to the present invention.

Referring first to FIG. 1, a heat pump system according to a first embodiment of the present invention comprises a main fluid circuit including a compressor 11, a utility-side heat exchanger (condenser) 12, a throttling device 13 and a source-side heat exchanger (evaporator) 14, all fluid-connected in a manner as shown. A fractionating separator 15 has an upper end fluid-connected with an outlet of the utility-side heat exchanger 12 and also with a suction port of a coolant ejector 16 disposed upstream of the utility-side heat exchanger 12 with respect to the direction of flow of medium, that is, on one side adjacent an inlet of the utility-side heat exchanger 12. The fractionating separator 15 has disposed therebelow a reservoir 18 having a heater 17 built therein, the bottom of said reservoir 18 being fluid connected with the source-side heat exchanger 14 through a shut-off valve 19 and a pressure reducer 20.

A method of varying the composition of the non-azeotropic mixed coolant filled in the heat pump system will now be described. In the first place, during the non-fractionating mode, when the heater 17 is turned off and the shut-off valve 19 is opened, an excessive coolant is stored in the reservoir 18, a portion of which flows to the source-side heat exchanger 14 through the pressure reducer 20, and, accordingly, the heat pump system operates with the composition of the mixed coolant rich of a high boiling point coolant as filled therein.

During the fractionating mode, when the heater 17 is turned on and the shut-off valve 19 is closed, a low boiling point coolant contained in the coolant within the reservoir 18 is mainly evaporated and ascends upwardly within the interior of the fractionating separator 1. At this time, a liquid coolant is supplied from an exit of the utility-side heat exchanger 12 to the upper end of the fractionating separator 15 and, as a result thereof, the fractionating takes place inside the fractionating separator 15 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 18 in the form of a condensed liquid. On the other hand, the ascending gaseous medium rich of the low boiling point coolant is guided to the suction port of the coolant ejector 15 disposed upstream of the utility-side heat exchanger 12 and, therefore, the amount of heat produced by the heater can be effectively utilized at the time the gaseous medium rich of the low boiling point coolant flows into the utility-side heat exchanger 12 in readiness for the subsequent condensation thereof. Thus, the main fluid circuit can be operated with the mixed coolant rich of the low boiling point coolant.

Where the composition in the main fluid circuit is desired to be restored to the original one, the heater 17 should be turned off and the shut-off valve 19 should be opened. In such case, the high boiling point coolant in the reservoir 18 flows into the main fluid circuit to make the mixed coolant in the main fluid circuit rich of the high boiling point coolant as filled therein.

It is to be noted that, in place of the heater 17, a high temperature heat source in a refrigerating cycle such as, for example, a discharge piping of the compressor 11 may be employed.

Figure 2:
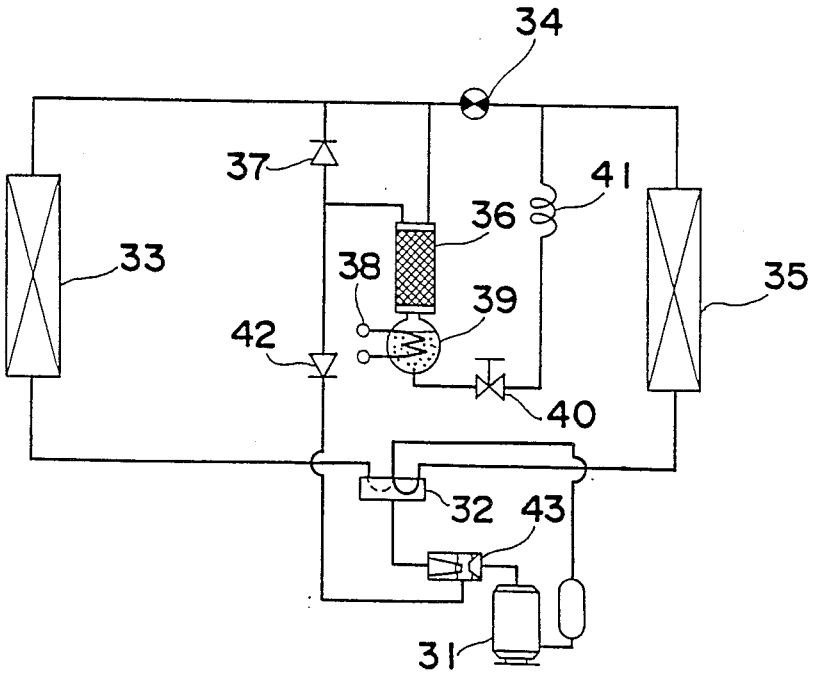
FIG. 2 is a schematic fluid circuit diagram showing one embodiment of the heat pump system capable of being operated selectively for heating and cooling according to the present invention.

In the embodiment shown in FIG. 2, the heat pump system shown therein comprises a main heat pump circuit including a compressor 31, a 4-way valve assembly 32, a utility-side heat exchanger 33 (acting as a condenser during a heating operation), a throttling device 34 and a source-side heat exchanger 35 (acting as an evaporator during the heating operation), all fluid-connected in a manner shown therein. Reference numeral 36 represents a fractionating separator filled with a filling material. This fractionating separator 36 has an upper end fluid-connected through a first check valve 37 with a piping connecting the throttling device 34 and the utility-side heat exchanger 33 together and has disposed therebelow a reservoir 39 having a heater 38 built therein. The bottom of the reservoir 39 is fluid connected through a shut-off valve 40 and a pressure reducer 41 with a piping connecting the source-side heat exchanger 35 and the throttling device 24 together. The upper end of the frationating separator 36 is also fluid-connected through a second check valve 42 to a suction port of a coolant ejector 43 which is disposed between the compressor 31 and the 4-way valve assembly 32. With this arrangement, the fractionating separator 36 can be connected to a high pressure side of the main fluid circuit during the heating operation and to a low pressure side of the main fluid circuit during a cooling operation.

A method of varying the composition of the non-azeotropic mixed coolant filled in the heat pump system will now be described. In the first place, during the non-fractionating mode, when the heater 38 is turned off and the shut-off valve 40 is opened, a portion of the coolant condensed in the utility-side heat exchanger 33 is, during the heating operation, divided, one component flowing through the fractionating separator 36 into the reservoir for the storage therein as an excessive coolant and the other component flowing through the shut-off calve 40 and then through the pressure reducer 41 to the source-side heat exchanger 35, and, accordingly, the heat pump system operates with the composition of the mixed coolant rich of a high boiling point coolant as filled therein. During the cooling operation, however, a portion of the coolant condensed in the source-side heat exchanger 35 is divided, one component flowing through the pressure reducer 41 and then through the shut-off valve 40 into the reservoir 39 for the storage therein as an excessive coolant and the other component flowing upwardly out from the fractionating separator 36 to the utility-side heat exchanger 33 and, accordingly, the heat pump system operates with the composition of the mixed coolant rich of a high boiling point coolant as filled therein.

During the fractionating mode taking place during the heating operation, when the heater 38 is turned on and the shut-off valve 40 is closed, a low boiling point coolant contained in the coolant within the reservoir 39 is mainly evaporated by the heater 38 and ascends upwardly within the interior of the fractionating separator 36. At this time, a portion of the liquid coolant condensed in the utility-side heat exchanger 33 is divided and supplied from an exit of the utility-side heat exchanger 33 to the upper end of the fractionating separator 36 and, as a result thereof, the fractionating takes place inside the fractionating separator 36 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 39 in the form of a condensed liquid. On the other hand, the ascending gaseous medium rich of the low boiling point coolant is guided through the second check valve 42 to the suction port of the coolant ejector 43 disposed between the compressor 31 and the 4-way valve assembly 32. By the suction effect achieved by the coolant ejector 43, the fractionating can be promoted and the amount of heat produced by the heater 38 can be effectively utilized at the time the gaseous medium rich of the low boiling point coolant flows into the utility-side heat exchanger 33 in readiness for the subsequent condensation thereof. Thus, the main fluid circuit can be operated with the mixed coolant rich of the low boiling point coolant.

During the fractionating mode taking place during the cooling operation, when the heater 38 is turned on and the shut-off valve 40 is closed, the low boiling contained in the coolant within the reservoir 39 is mainly evaporated by the heater 38 and ascends upwardly within the interior of the fractionating separator 36. At this time, a portion of the liquid coolant condensed in the source-side heat exchanger 35 and expanded by the throttling device 34 to a vapor pressure at which vaporization takes place is divided and supplied to the upper end of the fractionating separator 36 and, as a result thereof, the fractionating takes place inside the fractionating separator 36 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 39 in the form of a condensed liquid. On the other hand, the ascending gaseous medium rich of the low boiling point coolant is guided through the first check valve 37 to join the coolant then flowing through the main fluid circuit and then flows into the utility-side heat exchanger 33. In this way, the main fluid circuit can be operated with the mixed coolant rich of the low boiling point coolant. Thus, during the cooling operation the fractionating separator 36 is connected to the low pressure side of the main fluid circuit and, therefore, the temperature afforded by the heater 38 may be relatively low.

Where the composition in the main fluid circuit is desired to be restored to the original one, the heater 38 should be turned off and the shut-off valve 40 should be opened. In such case, the high boiling point coolant in the reservoir 18 flows into the main fluid circuit to make the mixed coolant in the main fluid circuit rich of the high boiling point coolant as filled therein.

It is to be noted that, in place of the heater 38, a high temperature heat source in a refrigerating cycle such as, for example, a discharge piping of the compressor 31 may be employed. In such case, the load which would be imposed on the source-side heat exchanger acting as the condenser during the cooling operation can be advantageously reduced.

Figure 3:
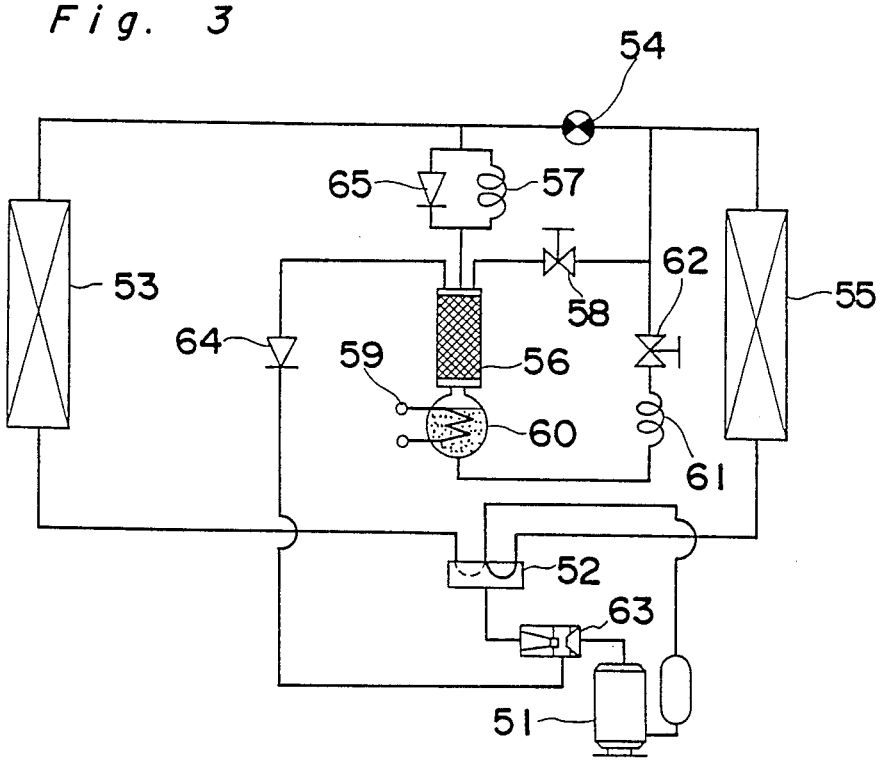
FIG. 3 is a schematic fluid circuit diagram showing another embodiment of the heat pump system capable of being operated selectively for heating and cooling according to the present invention.

In the embodiment shown in FIG. 3, the heat pump system shown therein comprises a main heat pump circuit including a compressor 51, a 4-way valve assembly 52, a utility-side heat exchanger 53 (acting as a condenser during a heating operation), a throttling device 54 and a source-side heat exchanger 55 (acting as an evaporator during the heating operation), all fluid-connected in a manner shown therein. Reference numeral 56 represents a fractionating separator filled with a filling material. This fractionating separator 56 has an upper end fluid-connected through a first pressure reducer 57 with a piping connecting the throttling device 54 and the utility-side heat exchanger 53 together and, also, through a first shut-off valve 58 with a piping connecting the source-side heat exchanger 55 and the throttling device 54 together. A reservoir 60 having a heater 59 built therein is disposed below the fractionating separator 56, the bottom of said reservoir 60 being fluid-connected through a second pressure reducer 61 and then through a second shut-off valve 62 with the piping connecting the source-side heat exchanger 55 and the throttling device 54 together. A coolant ejector 63 is disposed between the compressor 51 and the 4-way valve assembly 52, having a suction port fluid connected with the upper end of the fractionating separator 56 through a first check valve 64. In parallel relation with the first pressure reducer 57, a second check valve 65 is connected and is operable to allow the passage of the coolant therethrough towards the fractionating separator 56.

A method of varying the composition of the non-azeotropic mixed coolant filled in the heat pump system will now be described. In the first place, during the non-fractionating mode, when the heater 59 is turned off, the shut-off valve 58 is opened and the second shut-off valve 62 is opened, a portion of the coolant condensed in the utility-side heat exchanger 53 is, during the heating operation, divided, one component flowing through the second check valve 65 and the fractionating separator 56 into the reservoir 60 for the storage therein as an excessive coolant and the other component flowing through the second pressure reducer 61 and the second shut-off calve 62 to the source-side heat exchanger 55, and, accordingly, the main fluid circuit operates with the composition of the mixed coolant rich of a high boiling point coolant as filled therein. During the cooling operation, however, a portion of the coolant condensed in the source-side heat exchanger 55 is divided, one component flowing through the second shut-off valve 62 and the second pressure reducer 61 into the reservoir 60 for the storage therein as an excessive coolant and the other component flowing upwardly out from the fractionating separator 56 through the first pressure reducer 57 to the utility-side heat exchanger 53 and, accordingly, the main fluid circuit operates with the composition of the mixed coolant rich of a high boiling point coolant as filled therein.

During the fractionating mode taking place during the heating operation, when the heater 59 is turned on and the first and second shut-off valves 58 and 62 are both closed, a low boiling point coolant contained in the coolant within the reservoir 60 is mainly evaporated by the heater 59 and ascends upwardly within the interior of the fractionating separator 56. At this time, a portion of the liquid coolant condensed in the utility-side heat exchanger 53 is divided and a portion thereof is supplied through the second check valve 65 to the upper end of the fractionating separator 56 and, as a result thereof, the fractionating takes place inside the fractionating separator 56 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 60 in the form of a condensed liquid. On the other hand, the ascending gaseous medium rich of the low boiling point coolant is guided to the suction port of the coolant ejector 63 disposed between the compressor 51 and the 4-way valve assembly 52. By the suction effect achieved by the coolant ejector 63, the fractionating can be promoted and the amount of heat produced by the heater 58 can be effectively utilized at the time the gaseous medium rich of the low boiling point coolant flows into the utility-side heat exchanger 53 in readiness for the subsequent condensation thereof. Thus, the main fluid circuit can be operated with the mixed coolant rich of the low boiling point coolant.

During the fractionating mode taking place during the cooling operation, when the heater 59 is turned on and the first and second shut-off valves 58 and 62 are opened and closed, respectively, the low boiling contained in the coolant within the reservoir 60 is mainly evaporated by the heater 59 and ascends upwardly within the interior of the fractionating separator 56. At this time, a portion of the liquid coolant condensed in the source-side heat exchanger 55 is divided and supplied through the first shut-off valve 58 to the upper end of the fractionating separator 56 and, as a result thereof, the fractionating takes place inside the fractionating separator 56 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 59 in the form of a condensed liquid. On the other hand, the ascending gaseous medium rich of the low boiling point coolant is guided through the first pressure reducer 57 into the utility-side heat exchanger 53. In this way, the main fluid circuit can be operated with the mixed coolant rich of the low boiling point coolant.

Where the composition in the main fluid circuit is desired to be restored to the original one, the heater 59 should be turned off and both of the first and second shut-off valves 58 and 62 should be opened. In such case, the high boiling point coolant in the reservoir 60 lows into the main fluid circuit to make the mixed coolant in the main fluid circuit rich of the high boiling point coolant as filled therein.

It is to be noted that, in place of the heater 58, a high temperature heat source in a refrigerating cycle such as, for example, a discharge piping of the compressor 51 may be employed. In such case the load which would be imposed on the source-side heat exchanger 55 acting as the condenser during the cooling operation can be advantageously reduced.

In the embodiment shown in and described with reference to FIG. 3, the second check valve 65 has been used and connected parallel to the first pressure reducer 57 so that, during the heating operation, the fractionating separator 56 can be retained at a high pressure (condensing pressure) and the pressure of the low boiling point coolant gas to be sucked into the coolant ejector 63 can be increased, thereby enabling the check valve 64 to be get rid of. However, the present invention can be equally applicable to the case wherein no second check valve 65 is employed, in which case the low boiling point gaseous coolant to be sucked into the coolant ejector 63 may attain an intermediate pressure, however, the system of the present invention can work satisfactorily.

Also, the first shut-off valve 58 may be constituted by a pressure reducer and a check valve, and by the sucking power of the coolant ejector 63, the low boiling point gaseous coolant produced during the fractionating mode taking place during the heating operation can be sufficiently sucked towards a discharge side of the compressor.

Figure 4:
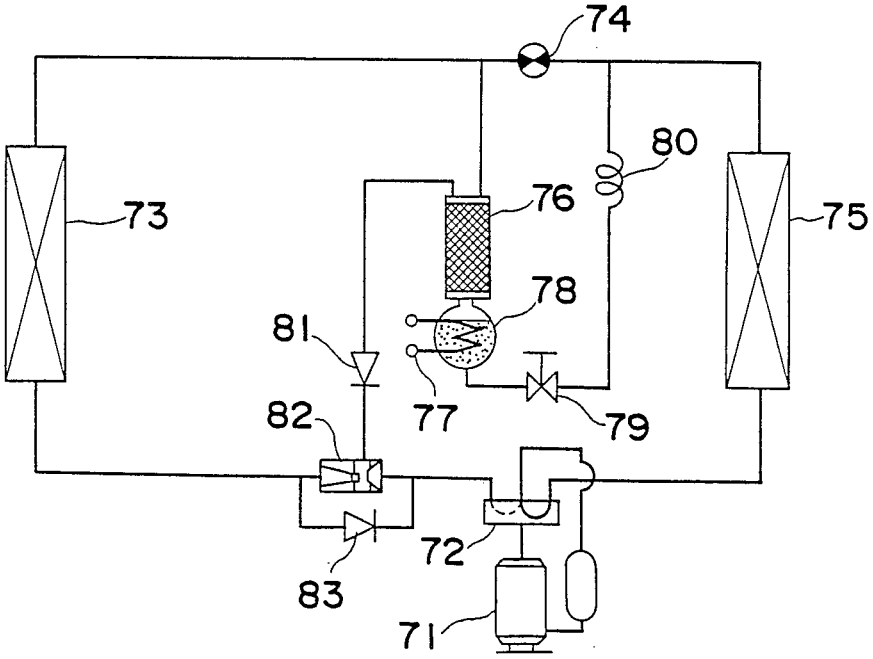
FIG. 4 is a schematic fluid circuit diagram showing a further embodiment of the heat pump system capable of being operated selectively for heating and cooling according to the present invention.

FIG. 4 illustrates the third preferred embodiment of the present invention, in which the heat pump system comprises a main heat pump circuit including a compressor 71, a 4-way valve assembly 72, a utility-side heat exchanger 73 (acting as a condenser during a heating operation), a throttling device 74 and a source-side heat exchanger 75 (acting as an evaporator during the heating operation), all fluid-connected in a manner shown therein. Reference numeral 76 represents a fractionating separator filled with a filling material. This fractionating separator 76 has an upper end fluid-connected with a piping connecting the throttling device 74 and the utility-side heat exchanger 73 together and has disposed therebelow a reservoir 78 having a heater 77 built therein. The bottom of the reservoir 78 is fluid connected through a shut-off valve 79 and a pressure reducer 80 with a piping connecting the source-side heat exchanger 75 and the throttling device 24 together. The upper end of the fractionating separator 76 is also fluid-connected through a first check valve 81 to a suction port of a coolant ejector 82 which is disposed between the 4-way valve assembly 72 and the utility-side heat exchanger 73. Reference numeral 83 represents a second check valve for bypassing the coolant ejector 82 during the cooling operation.

A method of varying the composition of the non-azeotropic mixed coolant filled in the heat pump system will now be described. In the first place, during the non-fractionating mode, when the heater 77 is turned off and the shut-off valve 79 is opened, a portion of the coolant condensed in the utility-side heat exchanger 73 is, during the heating operation, divided, one component flowing through the fractionating separator 76 into the reservoir 78 for the storage therein as an excessive coolant and the other component flowing through the shut-off calve 79 and then through the pressure reducer 80 to the source-side heat exchanger 75, and, accordingly, the heat pump system operates with the composition of the mixed coolant rich of a high boiling point coolant as filled therein. During the cooling operation, however, a portion of the coolant condensed in the source-side heat exchanger 75 is divided, one component flowing through the pressure reducer 80 and then through the shut-off valve 79 into the reservoir 78 for the storage therein as an excessive coolant and the other component flowing upwardly out from the fractionating separator 76 to the utility-side heat exchanger 73 and, accordingly, the heat pump system operates with the composition of the mixed coolant rich of a high boiling point coolant as filled therein.

During the fractionating mode taking place during the heating operation, when the heater 77 is turned on and the shut-off valve 79 is closed, a low boiling point coolant contained in the coolant within the reservoir 78 is mainly evaporated by the heater 77 and ascends upwardly within the interior of the fractionating separator 76. At this time, a portion of the liquid coolant condensed in the utility-side heat exchanger 73 is divided and supplied to the upper end of the fractionating separator 76 and, as a result thereof, the fractionating takes place inside the fractionating separator 76 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 78 in the form of a condensed liquid. On the other hand, the ascending gaseous medium rich of the low boiling point coolant is guided to the suction port of the coolant ejector 82 disposed between the compressor 71 and the 4-way valve assembly 72. By the suction effect achieved by the coolant ejector 82, the fractionating can be promoted and the amount of heat produced by the heater 77 can be effectively utilized at the time the gaseous medium rich of the low boiling point coolant flows into the utility-side heat exchanger 73 in readiness for the subsequent condensation thereof. Thus, the main fluid circuit can be operated with the mixed coolant rich of the low boiling point coolant.

During the fractionating mode taking place during the cooling operation, when the heater 77 is turned on and the shut-off valve 79 is closed, the low boiling contained in the coolant within the reservoir 78 is mainly evaporated by the heater 77 and ascends upwardly within the interior of the fractionating separator 76. At this time, a portion of the liquid coolant condensed in the source-side heat exchanger 75 and expanded by the throttling device 74 to a vapor pressure at which vaporization takes place is divided and supplied to the upper end of the fractionating separator 76 and, as a result thereof, the fractionating takes place inside the fractionating separator 76 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 79 in the form of a condensed liquid. On the other hand, the ascending gaseous medium rich of the low boiling point coolant is guided to the suction port of the coolant ejector 82 through the first check valve 81 and then to join the coolant then flowing through the main fluid circuit, finally flowing into the compressor 71. In this way, the main fluid circuit can be operated with the mixed coolant rich of the low boiling point coolant.

Where the composition in the main fluid circuit is desired to be restored to the original one, the heater 77 should be turned off and the shut-off valve 79 should be opened. In such case, the high boiling point coolant in the reservoir 78 flows into the main fluid circuit to make the mixed coolant in the main fluid circuit rich of the high boiling point coolant as filled therein.

According to the embodiment shown in and described with reference to FIG. 4, for the purpose of fractionating separation, only during the heating operation in which the recovery of the amount of heat consumed by the heater 77 may bring about effective results, the coolant ejector 82 is operated, but during the cooling operation in which the amount of heat consumed by the heater 77 need not be recovered, the gaseous coolant rich of the low boiling point coolant flowing out from the upper end of the fractionating separator 76 is guided so as to bypass the utility-side heat exchanger 73, which acts a an evaporator, and then into the suction side of the compressor 71. Therefore, any possible increase of a loss of pressure in the evaporator can be minimized and, at the same time, since the coolant flowing through the main fluid circuit can bypass the coolant ejector 82, the coolant ejector 82 can be prevented from constituting a cause of the loss of pressure.

Figure 5:
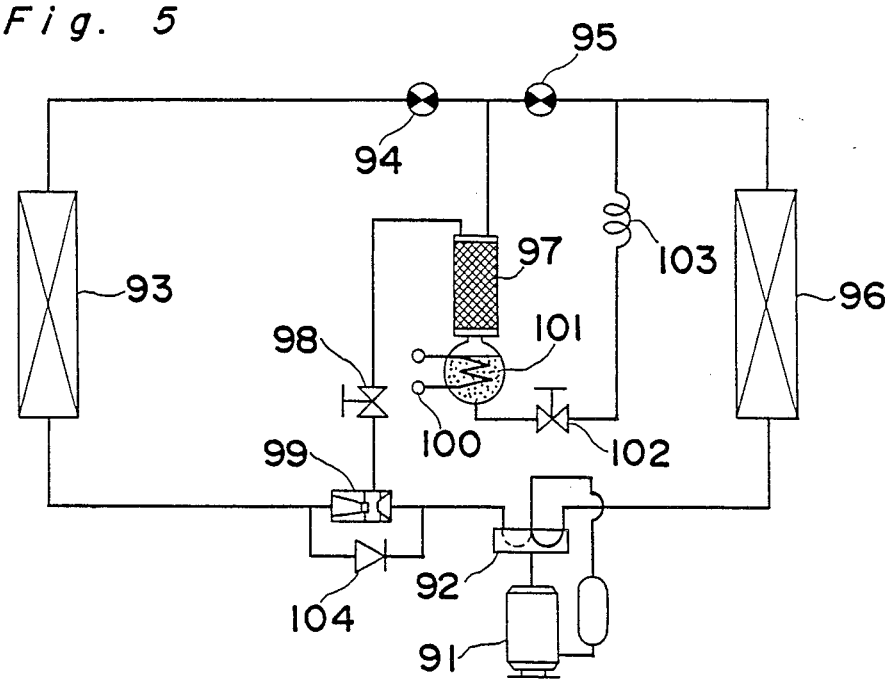
FIG. 5 is a schematic fluid circuit diagram showing a still further embodiment of the heat pump system capable of being operated selectively for heating and cooling according to the present invention.
Figure 6:
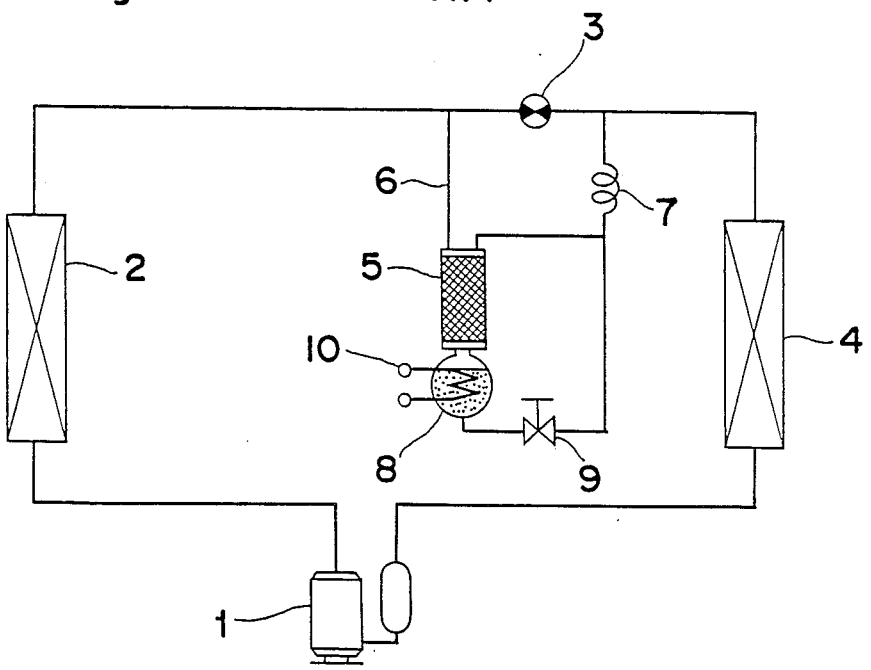
Fig. 6 Prior Art
FIG. 6 is a schematic fluid circuit diagram showing the prior art heat pump system.

FIG. 5 illustrates the fourth preferred embodiment of the present invention, in which the heat pump system comprises a main heat pump circuit including a compressor 91, a 4-way valve assembly 92, a utility-side heat exchanger 93 (acting as a condenser during a heating operation), a second throttling device 94, a first throttling device 95 and a source-side heat exchanger 96 (acting as an evaporator during the heating operation), all fluid-connected in a manner shown therein. Reference numeral 97 represents a fractionating separator filled with a filling material. This fractionating separator 97 has an upper end fluid-connected with a piping connecting the second and first throttling devices 94 and 95 and also through the shut-off valve 98 with a suction port of a coolant ejector 99 disposed between the 4-way valve assembly 92 and the utility-side heat exchanger 93. The fractionating separator 97 also has disposed therebelow a reservoir 101 having a heater 100 built therein. The bottom of the reservoir 101 is fluid-connected through a shut-off valve 102 and a pressure reducer 103 with a piping connecting the source-side heat exchanger 96 and the second throttling device 95 together. A check valve 104 for bypassing the coolant ejector 99 during the cooling operation is connected parallel to the coolant ejector 99.

A method of varying the composition of the non-azeotropic mixed coolant filled in the heat pump system will now be described. In the first place, during the non-fractionating mode, when the heater 100 is turned off and the shut-off valves 98 and 102 are closed and opened, respectively, a portion of the coolant condensed in the utility-side heat exchanger 93 and reduced in pressure by the second throttling device 94 to an intermediate value is, during the heating operation, divided, one component flowing through the fractionating separator 97 into the reservoir 101 for the storage therein as an excessive coolant and the other component flowing through the shut-off valve 102 and then through the pressure reducer 103 to the source-side heat exchanger 96, and, accordingly, the main fluid circuit operates with the composition of the mixed coolant rich of a high boiling point coolant as filled therein. During the cooling operation, however, a portion of the coolant condensed in the source-side heat exchanger 96 is divided, one component flowing through the pressure reducer 103 and then through the shut-off valve 102 into the reservoir 101 for the storage therein as an excessive coolant and the remaining component flowing upwardly out from the upper end of the fractionating separator 97 and then through the second throttling device 94 to the utility-side heat exchanger 93 and, accordingly, the main fluid circuit operates with the composition of the mixed coolant rich of a high boiling point coolant as filled therein.

During the fractionating mode, when the heater 100 is turned on and the shut-off valves 102 and 98 are closed and opened, respectively, a low boiling point coolant contained in the coolant within the reservoir 101 is, during the heating operation, evaporated by the heater 100 and ascends upwardly within the interior of the fractionating separator 97. At this time, a portion of the liquid coolant condensed in the utility-side heat exchanger 93 is, after having been reduced in pressure by the second throttling device 94 to the intermediate value, divided and supplied to the upper end of the fractionating separator 97 and, as a result thereof, the fractionating takes place inside the fractionating separator 97 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 101 in the form of a condensed liquid. On the other hand, the ascending gaseous medium rich of the low boiling point coolant is guided to the suction port of the coolant ejector 99 disposed between the 4-way valve assembly 92 and the utility-side heat exchanger 93. By the suction effect achieved by the coolant ejector 99, the fractionating can be promoted and the amount of heat produced by the heater 100 can be effectively utilized at the time the gaseous medium rich of the low boiling point coolant flows into the utility-side heat exchanger 93 in readiness for the subsequent condensation thereof. Thus, the main fluid circuit can be operated with the mixed coolant rich of the low boiling point coolant.

During the cooling operation, the low boiling contained in the coolant within the reservoir 101 is mainly evaporated by the heater 100 and ascends upwardly within the interior of the fractionating separator 97. At this time, a portion of the liquid coolant condensed in the source-side heat exchanger 96 is, after having been reduced in pressure by the first throttling device 95 to the intermediate value, divided and supplied to the upper end of the fractionating separator 97 and, as a result thereof, the fractionating takes place inside the fractionating separator 97 by the effect of a gas-liquid contact, the consequence of which is that the ascending gaseous medium becomes rich of the low boiling point coolant while the descending gaseous medium becomes rich of the high boiling point coolant, leaving the high boiling point coolant to be stored in the reservoir 101 in the form of a condensed liquid. On the other hand, the ascending gaseous medium rich of the low boiling point coolant is guided to the suction port of the coolant ejector 99, disposed between the 4-way valve assembly 92 and the utility-side heat exchanger 93, and then to the suction side of the compressor 91 through the 4-way valve assembly 92. Therefore, no increase of a loss of pressure occur which would otherwise occur when flowing into the utility-side heat exchanger 93 acting as an evaporator. In this way, the main fluid circuit can be operated with the mixed coolant rich of the low boiling point coolant.

Also, since the check valve 104 is employed and connected parallel to the coolant ejector 99 for bypassing the coolant ejector 99, the coolant ejector 99 will not constitute a cause of the loss of pressure during the cooling operation.

Where the composition in the main fluid circuit is desired to be restored to the original one, the heater 100 should be turned off and the shut-off valves 98 and 102 should be closed and opened, respectively. In such case, the high boiling point coolant in the reservoir 101 flows into the main fluid circuit to make the mixed coolant in the main fluid circuit rich of the high boiling point coolant as filled therein.

It is to be noted that, in place of the heater 100, a high temperature heat source in a refrigerating cycle such as, for example, a discharge piping of the compressor 91 may be employed. In such case, the load which would be imposed on the source-side heat exchanger 96 acting as the condenser during the cooling operation can be advantageously reduced, and, in the case where the fractionating separator 97 is desired to be maintained at the intermediate pressure, the heating temperature afforded by the heater 100 can be advantageously lowered.

Although the present invention has fully been described in connection with the various embodiments thereof with reference to the accompanying drawings, it is to be noted that various changes and modifications are apparent to those skilled in the art without departing from the scope of the present invention as defined by the appended claims. Such changes and modifications are to be understood as included therein unless they depart therefrom.

What is claimed is:

1. A heat pump system which comprises:

a main heat pump circuit filled with non-azeotropic mixed coolant and including a compressor, a utility-side heat exchanger, a throttling device, a source-side heat exchanger, etc.;

a fractionating separator having an upper end fluid-connected with an exit side of the utility-side heat exchanger;

a reservoir disposed beneath the fractionating separator and having a bottom fluid-connected through a shut-off valve with a low pressure piping on an inlet side of either the source-side heat exchanger or the utility-side heat exchanger; and a coolant ejector disposed between the compressor and the utility-side heat exchanger, wherein a gaseous medium generated from the fractionating separator when the reservoir is heated is guided to a suction port of the coolant ejector to flow into the main heat pump circuit.

2. The heat pump system as claimed in claim 1, further comprising a four-way valve assembly disposed between any one of the utility-side and source-side heat exchanger and the compressor, and wherein said coolant ejector is disposed between the compressor and the four-way valve assembly with the suction port thereof fluid-connected with the upper end of the fractionating separator such that, during the main heat pump circuit set in a heating operation and in a cooling operation, said utility-side heat exchanger acts as a condenser and an evaporator, respectively.

3. The heat pump system as claimed in claim 2, further comprising a check valve disposed between the upper end of the fractionating separator and the coolant ejector.

4. The heat pump system as claimed in claim 2, further comprising a first check valve through which the upper end of the fractionating separator is fluid-connected with a piping extending between the throttling device and the utility-side heat exchanger, and a second check valve through which the upper end of the fractionating separator is fluid-connected with the suction port of the coolant ejector, a junction between the first check valve and the throttle valve being connected with the upper end of the fractionating separator, and said reservoir being fluid-connected through the shut-off valve with a piping extending between the source-side heat exchanger and the throttling device.

5. The heat pump system as claimed in claim 2, further comprising a parallel fluid circuit including a check valve and a pressure reducer, the upper end of the fractionating separator being connected through said parallel fluid circuit with a piping extending between the throttling device and the utility-side heat exchanger, said upper end of the fractionating separator being coupled with the suction port of the coolant ejector through the check valve and also through a shut-off valve with a piping extending between the source-side heat exchanger and the throttling device, said reservoir being fluid-connected through the shut-off valve with a piping extending between the source-side heat exchanger and the throttling device.

6. The heat pump system as claimed in claim 1, further comprising a four-way valve assembly disposed between any one of the utility-side and source-side heat exchanger and the compressor, and wherein said coolant ejector is disposed between the compressor and the four-way valve assembly with the suction port thereof fluid-connected.

7. The heat pump system as claimed in claim 6, further comprising a check valve disposed parallel to the coolant ejector

8. The heat pump system as claimed in claim 6, further comprising a check valve disposed between the suction port of the coolant ejector and the upper end of the fractionating separator.

9. The heat pump system as claimed in claim 1, further comprising a second throttling device disposed between the utility-side heat exchanger and a junction of the throttling device with the fractionating separator, a piping extending between both of the throttling devices being fluid-connected with the upper end of the fractionating separator.

10. The heat pump system as claimed in claim 2, further comprising a second throttling device disposed between the utility-side heat exchanger and a junction of the throttling device with the fractionating separator, a piping extending between both of the throttling devices being fluid-connected with the upper end of the fractionating separator.

* * * * *